US008854027B2

(12) United States Patent
Lin et al.

(10) Patent No.: US 8,854,027 B2
(45) Date of Patent: Oct. 7, 2014

(54) CONTROL CIRCUIT AND TRACKING METHOD OF MAXIMUM POWER

(75) Inventors: Ray-Lee Lin, Tainan (TW); Ming-Ching Chou, Taichung (TW)

(73) Assignee: National Cheng Kung University, Tainan (TW)

( * ) Notice: Subject to any disclaimer, the term of this patent is extended or adjusted under 35 U.S.C. 154(b) by 57 days.

(21) Appl. No.: 13/242,083

(22) Filed: Sep. 23, 2011

(65) Prior Publication Data

US 2012/0074915 A1 Mar. 29, 2012

(30) Foreign Application Priority Data

Sep. 24, 2010 (TW) ..... 99132446 A

(51) Int. Cl.
*G05F 1/00* (2006.01)
*G05F 1/67* (2006.01)

(52) U.S. Cl.
CPC ..... *G05F 1/67* (2013.01); *Y10S 323/906* (2013.01)
USPC ..... 323/285; 323/299; 323/906

(58) Field of Classification Search
USPC ..... 363/53, 74, 78, 79, 80, 89, 90, 96, 95, 363/97, 123; 323/217, 222, 271, 282, 284, 323/285, 286, 351, 906, 299
See application file for complete search history.

(56) References Cited

U.S. PATENT DOCUMENTS 6,111,767 A 8/2000 Handleman
6,137,280 A * 10/2000 Ackermann et al. ..... 323/354
6,487,059 B2 * 11/2002 Bontempo et al. ..... 361/90
6,979,985 B2 * 12/2005 Yoshida et al. ..... 323/282
7,038,435 B2 * 5/2006 Ortiz et al. ..... 323/282
7,834,608 B2 * 11/2010 Cheng et al. ..... 323/299
2006/0132102 A1 6/2006 Harvey
2006/0273740 A1 * 12/2006 Saeueng et al. ..... 315/291
2007/0188154 A1 * 8/2007 Fan et al. ..... 323/273
2008/0062731 A1 * 3/2008 Chang et al. ..... 363/78
2008/0278134 A1 * 11/2008 Murata ..... 323/284

FOREIGN PATENT DOCUMENTS

JP 2001178145 6/2001

OTHER PUBLICATIONS

Schicheng, Zheng et al., "Study on Improving Output Current Waveform of Photovoltaic Grid-Connected System", May 24-26, 2006, pp. 1-5, Industrial Electronics and Applications, 2006 1st IEEE Conference on.*

* cited by examiner

*Primary Examiner* — Gary L Laxton
*Assistant Examiner* — Alex Torres-Rivera
(74) *Attorney, Agent, or Firm* — Muncy, Geissler, Olds & Lowe, P.C.

(57) ABSTRACT

A control circuit controls a power output module and drives a load device. The control circuit includes a conversion unit, a feed-forward unit, a feedback unit and a control unit. The conversion unit generates a driving signal according to an output signal of the power output module for driving the load device. The feed-forward unit generates a duty cycle reference signal according to the output signal. The feedback unit generates a feedback signal according to the driving signal. The control unit outputs a control signal to control the conversion unit according to the duty cycle reference signal and feedback signal, thereby limiting the output power of the power output module within the maximum power region. A tracking method of the maximum power is also disclosed.

20 Claims, 10 Drawing Sheets

CONTROL CIRCUIT AND TRACKING METHOD OF MAXIMUM POWER

CROSS REFERENCE TO RELATED APPLICATIONS

This Non-provisional application claims priority under 35 U.S.C. §119(a) on Patent Application No(s). 099132446 filed in Taiwan, Republic of China on Sep. 24, 2010, the entire contents of which are hereby incorporated by reference.

BACKGROUND OF THE INVENTION

1. Field of Invention

The present invention relates to a circuit and a tracking method, and in particular, to a control circuit and a tracking method of a maximum power.

2. Related Art

In the recent years, in the wake of heightened environmental consciousness and petrochemical energy such as petroleum and coal is running out, countries worldwide have started to realize an importance of developing new energy. Because sunlight is an energy, which is inexhaustible in supply and always available for use, we do not have to worry that it will run out and the problem with monopolization can also be avoided. Therefore, countries worldwide are devoted to developing applied technology of solar energy, expecting to be less dependable on petrochemical energy by increasing the utilization of solar energy. Solar energy is mainly applied to solar cell or also called photovoltaic (PV) cell, by which light energy is directly converted into electric energy, and an output power can be supplied for a load device.

Referring to FIG. 1A, it shows characteristic curves of an output voltage ($V_{PV}$) and an output current ($I_{PV}$) of a conventional solar cell under four different sunlight intensities. It is shown in the figure that under different sunlight intensities, the characteristic curves of the voltage and the current only change on different levels, but curvatures of the characteristic curves remain the same.

In addition, the characteristic curves are divided into a current source region A, a voltage source region B and a maximum power region C (the characteristic curve of a sunlight intensity of 1000 W/m$^2$ is used as an example) based on output characteristics of the solar cell. When a power required by a load is smaller than a maximum power supplied by the solar cell (i.e. the load current is smaller, and an output power of the solar cell is adequate for the load), an operating point for the solar cell is located in the voltage source region B. Besides, when the power required by the load is larger than the maximum power supplied by the solar cell (i.e. the load current is larger, and the output power of the solar cell is not adequate for the load), the operating point for the solar cell is located in the current source region A. Furthermore, when the power required by the load is equal to the maximum power supplied by the solar cell, the operating point for the solar cell is located in the maximum power region C, and the solar cell has the maximum power output.

FIG. 1B is a block diagram of a conventional photovoltaic control circuit 1 with a maximum power tracking function. Referring to FIG. 1B, the photovoltaic control circuit 1 controls and converts an output of a solar cell module PVM for supplying a load device L. The photovoltaic control circuit 1 comprises a conversion unit 11, two analog and digital converters 12 and 13, a gate driving unit 14, and a control unit 15.

The conversion unit 11 is electrically connected to the solar cell module PVM and the load device L, and converts an output signal P1 of the solar cell module PVM into a driving signal P2 for the load device L. Furthermore, the analog and digital converters 12 and 13 are respectively electrically connected to the solar cell module PVM, the conversion unit 11 and the control unit 15, and respectively converts an analog output signal P1 outputted by the solar cell module PVM and an analog driving signal P2 outputted by the conversion unit 11 into digital signals, for inputting into the control unit 15, respectively. The control unit 15 is electrically connected to the gate driving unit 14, and receives outputs from the analog and digital converters 12 and 13 to generate a control signal P3 to control an actuation of the gate driving unit 14, and thus to control an actuation of the conversion unit 11. Accordingly, an output power of the solar cell module PVM is controlled within the maximum power region C as shown in FIG. 1A, and the solar cell module PVM has a maximum power output for the load device L.

However, the control unit 15 of the photovoltaic control circuit 1 typically employs a digital chip, such as a field-programmable gate array (FPGA) processor, a digit signal processor (DSP) or a programmable interface controller (PIC). Moreover, because the digital chip is used, the photovoltaic control circuit 1 requires two analog and digital converters 12 and 13 for signal conversion. Thus the circuit cost for the photovoltaic control circuit 1 will be fairly high.

Therefore, it is an important subject of the present invention to provide a control circuit and a tracking method of a maximum power for limiting an output power of a power output module within a maximum power region, with a lower circuit cost.

SUMMARY OF THE INVENTION

In view of the foregoing, an object of the present invention is to provide a control circuit and a tracking method of a maximum power for limiting an output power of a power output module within a maximum power region, with a lower circuit cost.

To achieve the above objective, the present invention discloses a control circuit, to control a power output module and to drive a load device, including a conversion unit, a feed-forward unit, a feedback unit, and a control unit. The conversion unit is electrically connected with the power output module and the load device, and generates a driving signal according to an output signal of the power output module to drive the load device. The feed-forward unit is electrically connected with the power output module and the conversion unit, and generates a duty cycle reference signal according to the output signal. The feedback unit is electrically connected with the conversion unit, the load device and the feed-forward unit, and generates a feedback signal according to the driving signal. The control unit is electrically connected with the feed-forward unit, the feedback unit and the conversion unit, and outputs a control signal to control the conversion unit according to the duty cycle reference signal and the feedback signal, thereby limiting an output power of the power output module within a maximum power region.

In one embodiment of the present invention, the conversion unit has a switch element, and the control signal controls to turn on the switch element, thereby causing the power output module to output the output signal over again.

In one embodiment of the present invention, the feed-forward unit comprises a low pass filter electrically connected with the power output module, and generating a transient voltage average signal according to the output signal.

In one embodiment of the present invention, the feed-forward unit further comprises a subtractor electrically connected with the power output module and the low pass filter, and subtracting the output signal and the transient voltage average signal with each other, so that the duty cycle reference signal is generated and inputted into the control unit.

In one embodiment of the present invention, the feedback unit comprises a compensator electrically connected with the conversion unit, and converting a voltage of the driving signal into a voltage feedback compensation signal.

In one embodiment of the present invention, the feedback unit further comprises an isolation element electrically connected with the compensator and the control unit, and outputting the voltage feedback signal to the control unit according to the voltage feedback compensation signal.

In one embodiment of the present invention, the feedback unit further comprises a voltage dividing element electrically connected with the control unit, and converting a current of the driving signal into the current feedback signal, and inputting it into the control unit.

In one embodiment of the present invention, the control unit integrates the duty cycle reference signal and the feedback signal, and outputs the control signal to control an actuation of the conversion unit.

In one embodiment of the present invention, when the duty cycle reference signal is larger than a preset reference value, the control unit outputs the control signal.

To achieve the above objective, the present invention also discloses a tracking method of a maximum power, which is applied to a power output module. The power output module outputs an output signal, and a conversion unit outputs a driving signal according to the output signal to drive a load device. The tracking method includes the steps of generating a duty cycle reference signal according to the output signal; generating a feedback signal according to the driving signal; generating a control signal according to the duty cycle reference signal and the feedback signal; and controlling the conversion unit according to the control signal, so that the output power of the power output module is limited within a maximum power region.

In one embodiment of the present invention, the control signal controls to turn on a switch element of the conversion unit.

In one embodiment of the present invention, before the step of generating the duty cycle reference signal, the method further comprises a step of generating a transient voltage average signal according to the output signal.

In one embodiment of the present invention, before the step of generating the duty cycle reference signal, the method further comprises a step of subtracting the output signal and the transient voltage average signal with each other.

In one embodiment of the present invention, before the step of generating the feedback signal, the method further comprises a step of generating a voltage feedback compensation signal according to a voltage of the driving signal.

In one embodiment of the present invention, before the step of generating the feedback signal, the method further comprises a step of generating the voltage feedback signal according to the voltage feedback compensation signal.

In one embodiment of the present invention, before the step of generating the feedback signal, the method further comprises a step of sensing a current of the driving signal and converting it into the current feedback signal.

In one embodiment of the present invention, the method further comprises a step of integrating the duty cycle reference signal and the feedback signal, and outputting the control signal.

In one embodiment of the present invention, the method further comprises a step of comparing the duty cycle reference signal with a preset reference value.

In one embodiment of the present invention, when the duty cycle reference signal is larger than the preset reference value, the control unit outputs the control signal to control an actuation of the conversion unit.

As mentioned above, in the control circuit and tracking method of the maximum power of the present invention, the feed-forward unit generates a duty cycle reference signal according to the output signal of the power output module, and the feedback unit generates a feedback signal according to the driving signal output by the conversion unit. Besides, the control unit outputs a control signal to control the actuation of the switch element of the conversion unit to re-start the conversion unit, and cause the power output module to output over again according to the duty cycle reference signal and the feedback signal. Thus, the control circuit of the present invention can limit the output power of the power output module within the maximum power region, and the control circuit has a tracking function of the maximum power. In addition, the control circuit of the present invention is an analog circuit, comparing with the conventional control circuits which use digital chips, it is simpler structurally and the circuit cost is lower.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
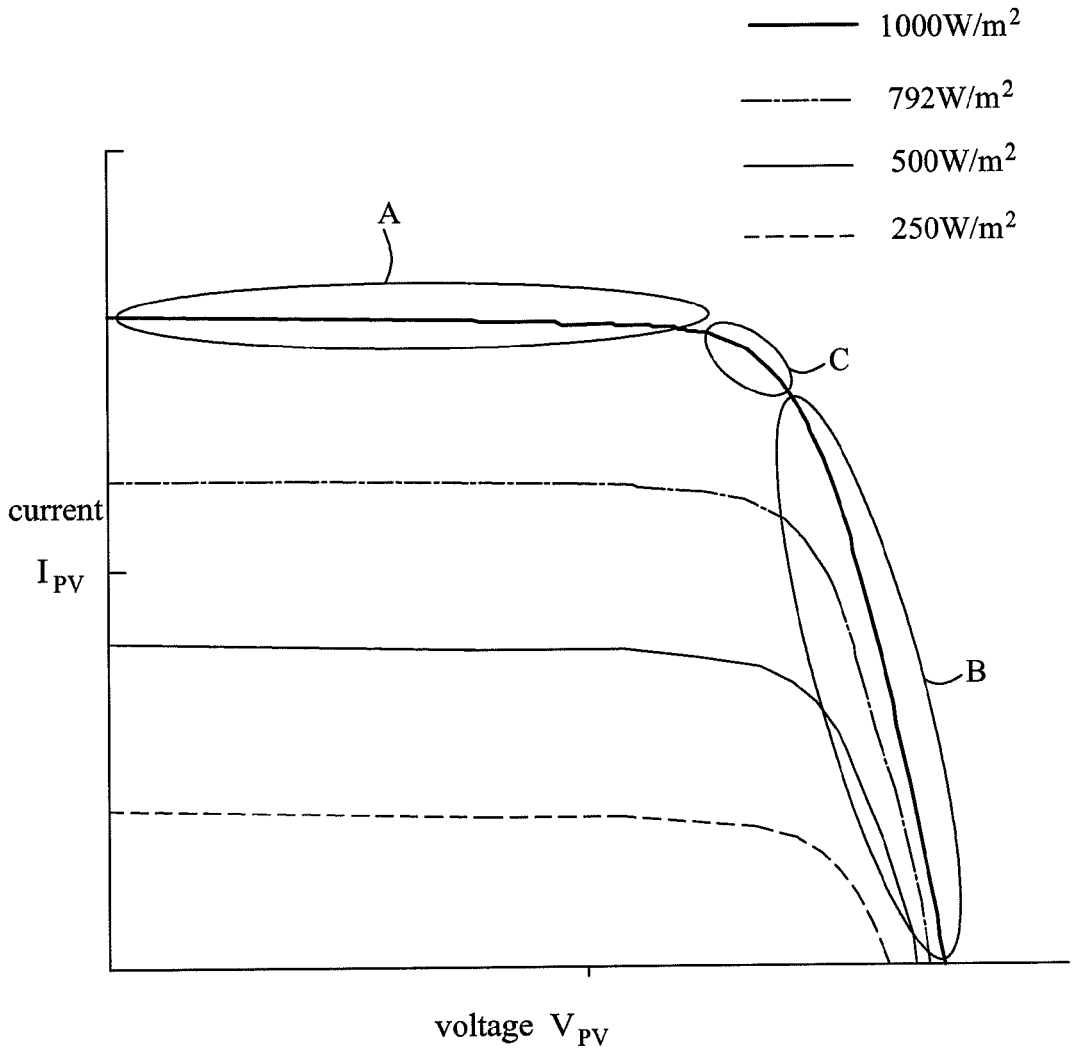
FIG. 1A(Prior Art)
FIG. 1A is an illustration of characteristic curves of an output voltage and an output current of the conventional solar cell under different sunlight intensities.
Figure 1B:
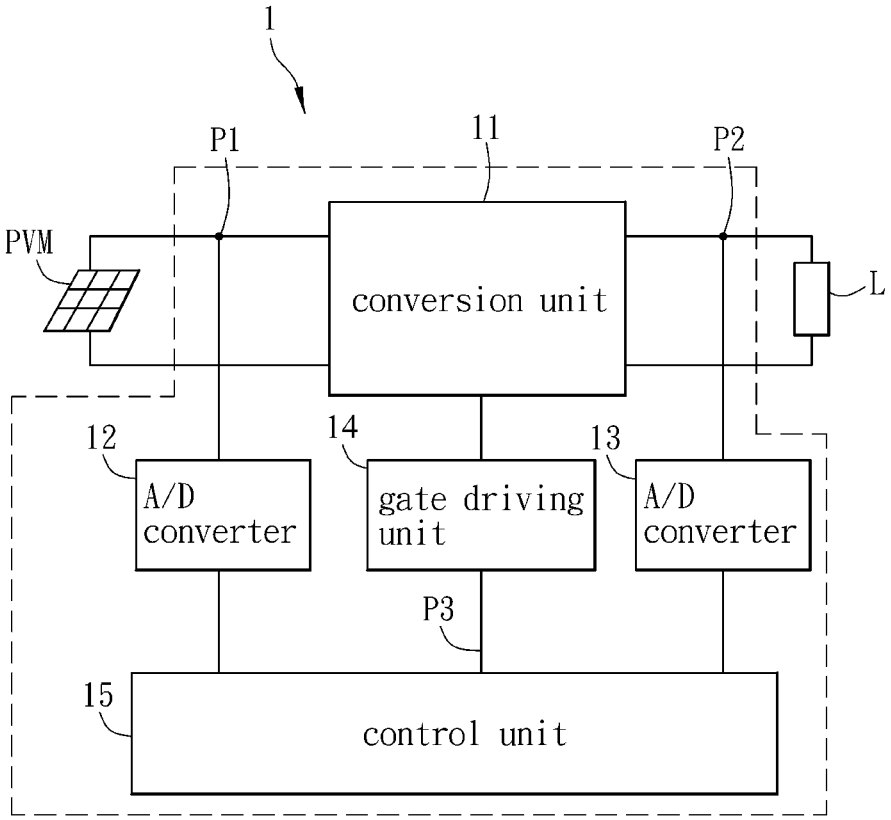
FIG. 1B(Prior Art)
FIG. 1B is a block diagram of functions of a conventional photovoltaic control circuit with a maximum power tracking function.
Figure 2:
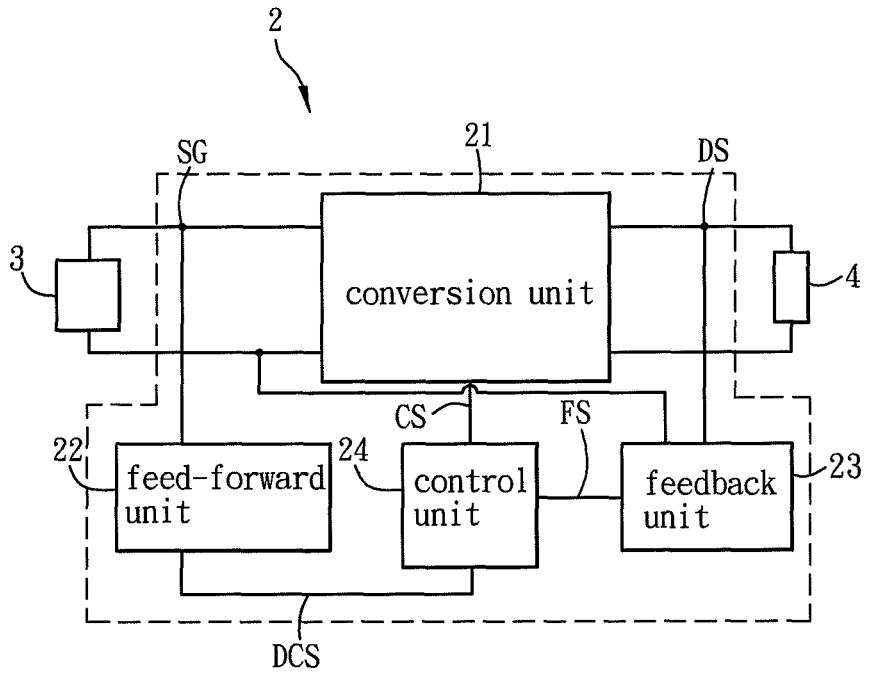
FIG. 2 is a block diagram of functions of a control circuit according to a preferred embodiment of the present invention.

FIG. 2 is a block diagram of functions of a control circuit 2 according to a preferred embodiment of the present invention. Referring to FIG. 2, the control circuit 2 is used to control an output of a power output module 3 to supply a power to drive a load device 4. The power output module 3 includes a solar cell component or a solar cell module. The power output module 3 can be a solar cell, or the power output module 3 can be composed of a plurality of solar cells connected in parallel and/or in series. It is not limited in the present invention. Furthermore, the load device 4 can be a home appliance, a mobile phone, a computer, a GPS, a PDA, or other electronic products.

The control circuit 2 includes a conversion unit 21, a feed-forward unit 22, a feedback unit 23 and a control unit 24.

The conversion unit 21 is electrically connected with the power output module 3 and the load device 4. The conversion unit 21 generates a driving signal DS according to an output signal SG of the power output module 3 for driving the load device 4. In other words, the conversion unit 21 converts the output signal SG for supplying a power for the load device 4. The conversion unit 21 is, for example a DC/DC converter or an AC/DC converter. Furthermore, the output signal SG is a transient voltage outputted by the power output module 3.

The feed-forward unit 22 is electrically connected with the power output module 3 and the conversion unit 21. The feed-forward unit 22 generates a duty cycle reference signal DCS according to the output signal SG and inputs the duty cycle reference signal DCS into the control unit 24.

The feedback unit 23 is electrically connected with the conversion unit 21, the load device 4 and the feed-forward unit 22. The feedback unit 23 generates a feedback signal FS according to the driving signal DS and the current of power output module for inputting into the control unit 24. The feedback unit 23 converts a voltage of the driving signal DS and a current of the power output module respectively into a voltage feedback signal and a current feedback signal (not shown in the figure).

The control unit 24 is electrically connected with the feed-forward unit 22, the feedback unit 23 and the conversion unit 21. The control unit 24 outputs a control signal CS according to the duty cycle reference signal DCS and the feedback signal FS, for inputting into the conversion unit 21 and for controlling an actuation of the conversion unit 21, thereby limiting an output power of the power output module 3 within a maximum power region.

Figure 3:
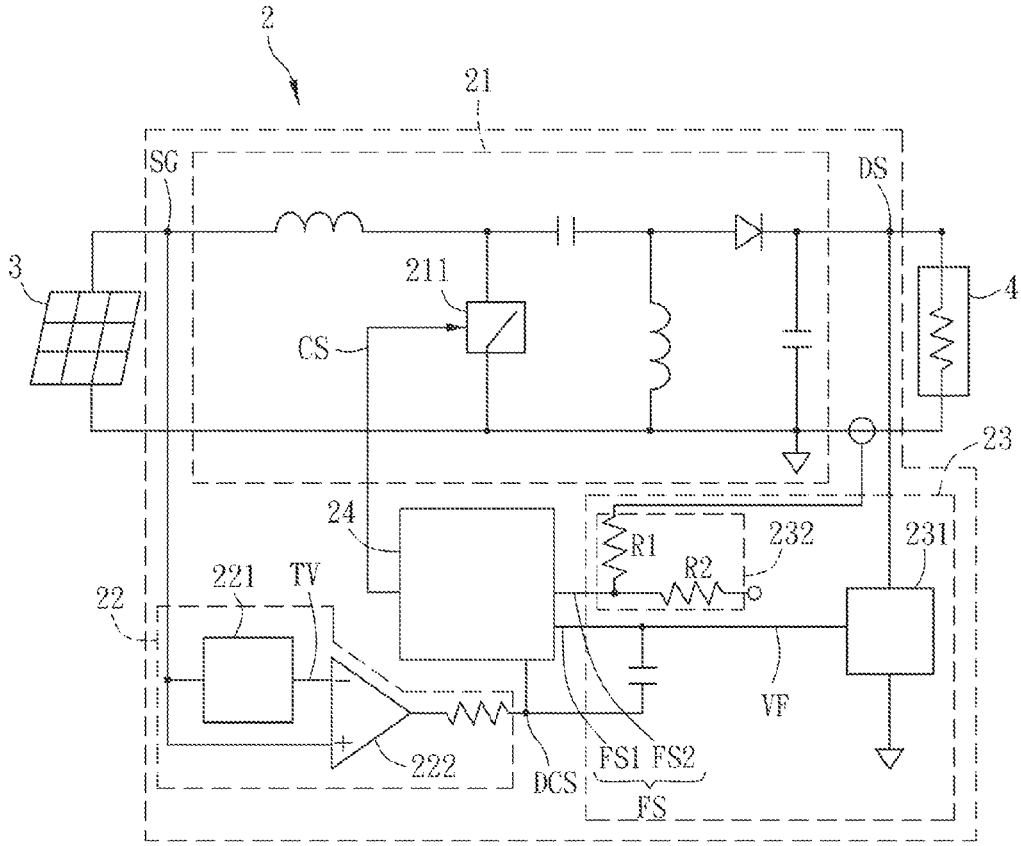
FIG. 3 is a circuit diagram of a control circuit according to the present invention.

Referring to FIG. 3, which is a circuit diagram of a control circuit according to the present invention, it illustrates an actuation of the control circuit 2 of the present invention. To be noted, the control circuit 2 of the present invention is an analog circuit.

In this embodiment, the load device 4 is a load which uses a direct current as an example. Therefore, the conversion unit 21 is a DC/DC converter, and it converts the output signal SG of direct current to drive the load device 4 which uses a direct current. In other embodiments, if the load device 4 is a load which uses an alternating current, then the conversion unit 21 is a DC/AC converter. Furthermore, the conversion unit 21 of the present embodiment has a switch element 211, and the control signal CS controls the switch element 211 to re-start the conversion unit 21.

The feed-forward unit 22 has a low pass filter 221, which is electrically connected with the power output module 3. The low pass filter 221 generates a transient voltage average signal TV according to the output signal SG. In other words, the low pass filter 221 of the feed-forward unit 22 filters out high frequency noises of the output signal SG and only low frequency signals are allowed to pass through in order to output the transient voltage average signal TV. In addition, the feed-forward unit 22 can further include a subtractor 222, which is electrically connected with the power output module 3 and the low pass filter 221. The subtractor 222 subtracts the output signal SG and the transient voltage average signal TV outputted by the low pass filter 221 with each other, so as to generate the duty cycle reference signal DCS, and input it into the control unit 24.

The feedback unit 23 has a compensator 231, which is electrically connected with the conversion unit 21. The compensator 231 converts a voltage of the driving signal DS into a voltage feedback compensation signal VF. The compensator 231 performs both phase and gain compensations for the voltage of the driving signal DS, and outputs the voltage feedback compensation signal VF. In this embodiment, the voltage feedback compensation signal VF is directly inputted into the control unit 24, so that the voltage feedback compensation signal VF is a voltage feedback signal FS1 as shown in FIG. 3.

Furthermore, the feedback unit 23 further includes a voltage dividing element 232, which is electrically connected with the control unit 24. The voltage dividing element 232 converts a current of the power output module into a current feedback signal FS2, and inputs into the control unit 24. The voltage dividing element 232 has two resistors R1 and R2. It should be noted that, the resistor R1 converts a current flowed into the control unit 24 into a voltage, so that the current feedback signal FS2 inputted into the control unit 24 is virtually a voltage signal.

In addition, the control unit 24 integrates the duty cycle reference signal DCS and the feedback signal FS (including the voltage feedback signal FS1 and the current feedback signal FS2), then outputs the control signal CS to control the conversion unit 21, and causes the power output module 3 to output over again, thereby limiting the output power of the power output module 3 within the maximum power region.

Figure 4A:
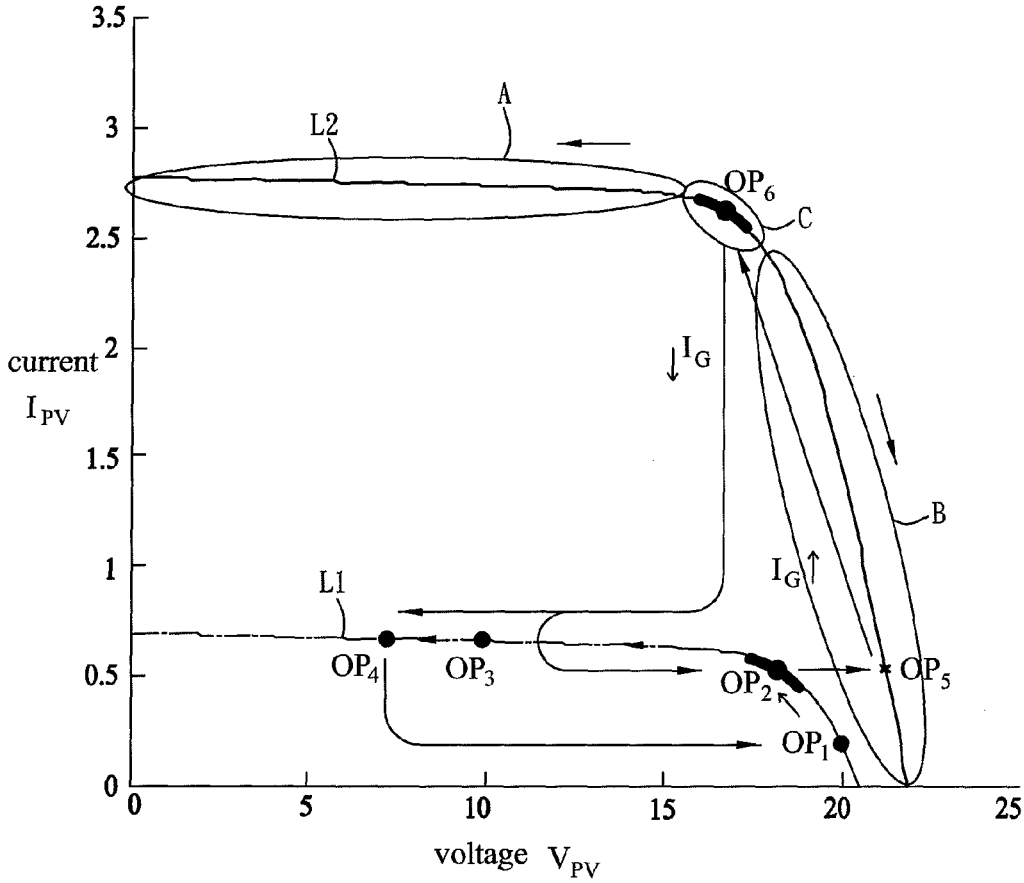
FIG. 4A is an illustration of characteristic curves of an output voltage and an output current of a power output module under different sunlight intensities.

Referring FIGS. 4A and 3, if the current feedback signal FS2 is on an increase, it indicates the higher the current of the driving signal DS which drives the load device 4 will get, so that the current of the output signal SG of the power output module 3 is also on an increase. As shown in FIG. 4A, an operating point of the power output module 3 moves toward a higher current of the current source region A (as indicated by an arrow direction of the current source region A). Thus the control unit 24 can control the switch element 211 to re-start the conversion unit 21, and cause the power output module 3 to output over again. Furthermore, if the voltage feedback signal FS1 is on an increase, it indicates the higher the voltage of the driving signal DS which drives the load device 4 will get, so that the voltage of the output signal SG of the power output module 3 is also on an increase. As shown in FIG. 4A, an operating point of the power output module 3 moves toward a higher voltage of the voltage source region B (as indicated by an arrow direction of the voltage source region B). Thus the control unit 24 can control and reduce a duty cycle of the output signal SG of the power output module 3.

In addition, when the duty cycle reference signal DCS is larger than a preset reference value, the control unit 24 outputs the control signal CS to conduct the switch element 211. In other words, the control unit 24 can compare the duty cycle reference signal DCS with a preset reference value internally. When the duty cycle reference signal DCS is larger than the preset reference value, the control unit 24 outputs the control signal CS to turn on the switch element 211 so as to re-start the conversion unit 21, and cause the power output module 3 to output over again.

Referring to FIG. 4A again, an actuation of the control circuit 2 of the present invention will be further described in details. FIG. 4A shows two characteristic curves L1 and L2 of the power output module 3. The curve L1 is a characteristic curve of an output voltage ($V_{PV}$) and an output current ($I_{PV}$) of the power output module 3 under a certain sunlight intensity; while the curve L2 is a characteristic curve of an output voltage ($V_{PV}$) and an output current ($I_{PV}$) of the power output module 3 under another certain sunlight intensity. The sunlight intensity of the curve L2 is larger than that of the curve L1. Furthermore, only the current source region A, the voltage source region B and the maximum power region C of the curve L2 are indicated in FIG. 4A, by the same token, the curve L1 can also have the current source region A, the voltage source region B and the maximum power region C (not shown in the figure).

Initially, the power output module 3 operates at an operating point $OP_1$ of the curve L1. At this time, the current of the output signal SG of the power output module 3 is a smallest operating current. As a load required by the load device 4 gets higher, in order for the power output module 3 to supply adequate power for the load device 4, the power output module 3 moves toward an operating point $OP_2$ of the maximum power region C from the operating point $OP_1$ of the voltage source region B. At the operating point $OP_2$, the power output module 3 operates in the maximum power region C of the curve L1, and outputs a maximum power.

Then, assume that an intensity of sunlight remains the same, as a required load gets higher, a power required by the load device 4 also gets higher. In order to supply a power and a current required by the load device 4, the power output module 3 moves toward an operating point $OP_3$ of the current source region A of a higher current from the operating point $OP_1$. If a current required by the load is on an increase, the control unit 24 of the control circuit 2 integrates the duty cycle reference signal DCS, the voltage feedback signal FS1 and the current feedback signal FS2 and performs an estimation. When the duty cycle reference signal DCS is larger than the preset reference value, it indicates that the output of the power output module 3 is already overloaded. Therefore, the control unit 24 outputs the control signal CS to turn on the switch element 211 so as to re-start the conversion unit 21, and cause the power output module 3 to output over again. The power output module 3 will move back to the operating point $OP_1$ from an operating point $OP_4$, and then, as mentioned above, the power output module 3 moves toward the operating point $OP_2$ of the maximum power region C again. Therefore, when a power required by the load device 4 is larger than that the power output module 3 can supply, the control circuit 2 can then control and limit the power output module 3 to operate in the maximum power region C of the curve L1.

In addition, when the power output module 3 operates at the operating point $OP_2$ of the maximum power region C, and if the sunlight intensity increases, the characteristic curve will be changed from the curve L1 to the curve L2, which indicates that a power supplied by the power output module 3 becomes larger. Because the power supplied by the power output module 3 becomes larger, the operating point of the power output module 3 moves from the operating point $OP_2$ of the curve L1 to an operating point $OP_5$ of the curve L2, and then to an operating point $OP_6$ of the curve L2. At the operating point $OP_6$, the power output module 3 operates in the maximum power region C of the curve L2.

When a power required by the load device 4 continues to increase, a power and a current of the output signal SG of the power output module 3 will also continue to increase. Thus, the power output module 3 is overloaded, and the control unit 24 of the control circuit 2 actuates as mentioned above, wherein the control unit 24 outputs the control signal CS to turn on the switch element 211 so as to re-start the conversion unit 21, and cause the power output module 3 to output over again. Therefore, an operating point of the power output module 3 moves from the operating point $OP_6$ back to the operating point $OP_5$. When an output power of the power output module 3 is adequate for the load device 4, an operating point of the power output module 3 moves to the operating point $OP_6$ of the maximum power region C again. Thus the control circuit 2 can control and limit the power output module 3 to operate in the maximum power region C.

When the power output module 3 operates at the operating point $OP_6$ of the maximum power region C, and if the sunlight intensity decreases, the characteristic curve will be changed from the curve L2 to the curve L1. At this time, an operating point of the power output module 3 moves down from the operating point $OP_6$ of the curve L2 to the operating point $OP_2$ of the curve L1; otherwise, an operating point of the power output module 3 moves from the operating point $OP_6$ of the curve L2 to the operating points $OP_3$, $OP_4$ and $OP_1$ of the curve L1, and then to the operating point $OP_2$ of the maximum power region of the curve L1.

Figure 4B:
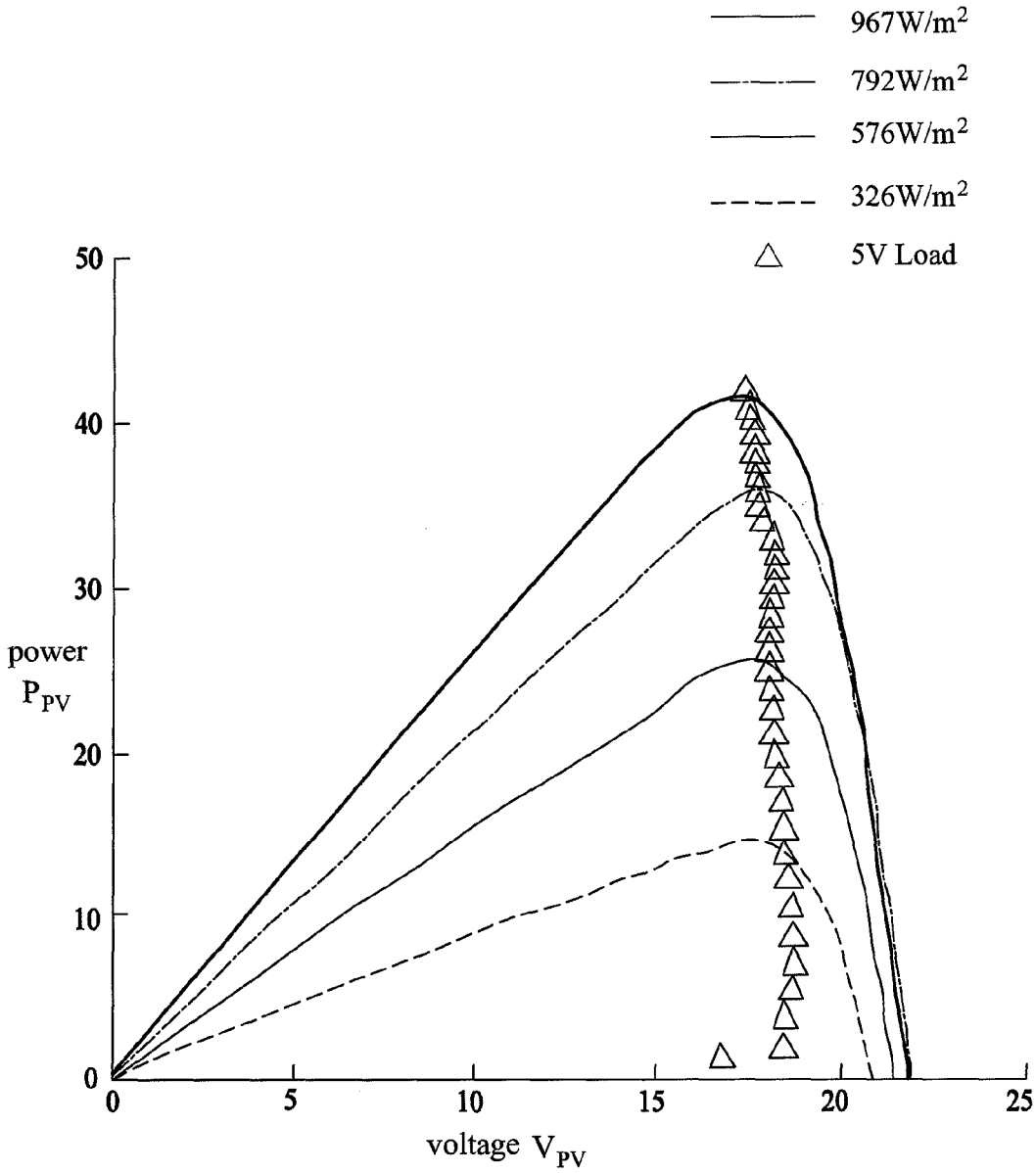
FIG. 4B is an illustration of characteristic curves of an output power and an output voltage of a power output module under different sunlight intensities.

FIG. 4B is an illustration of characteristic curves of an output power ($P_{PV}$) and an output voltage ($V_{PV}$) of a power output module 3 under different sunlight intensities.

The load device 4 with a rated voltage of 5V is used as an example. As shown in FIG. 4B, even under different sunlight intensities, the control circuit 2 can still limit the output power $P_{PV}$ of the power output module 3 in the maximum power regions of the curves as indicated by Δ.

Figure 5A:
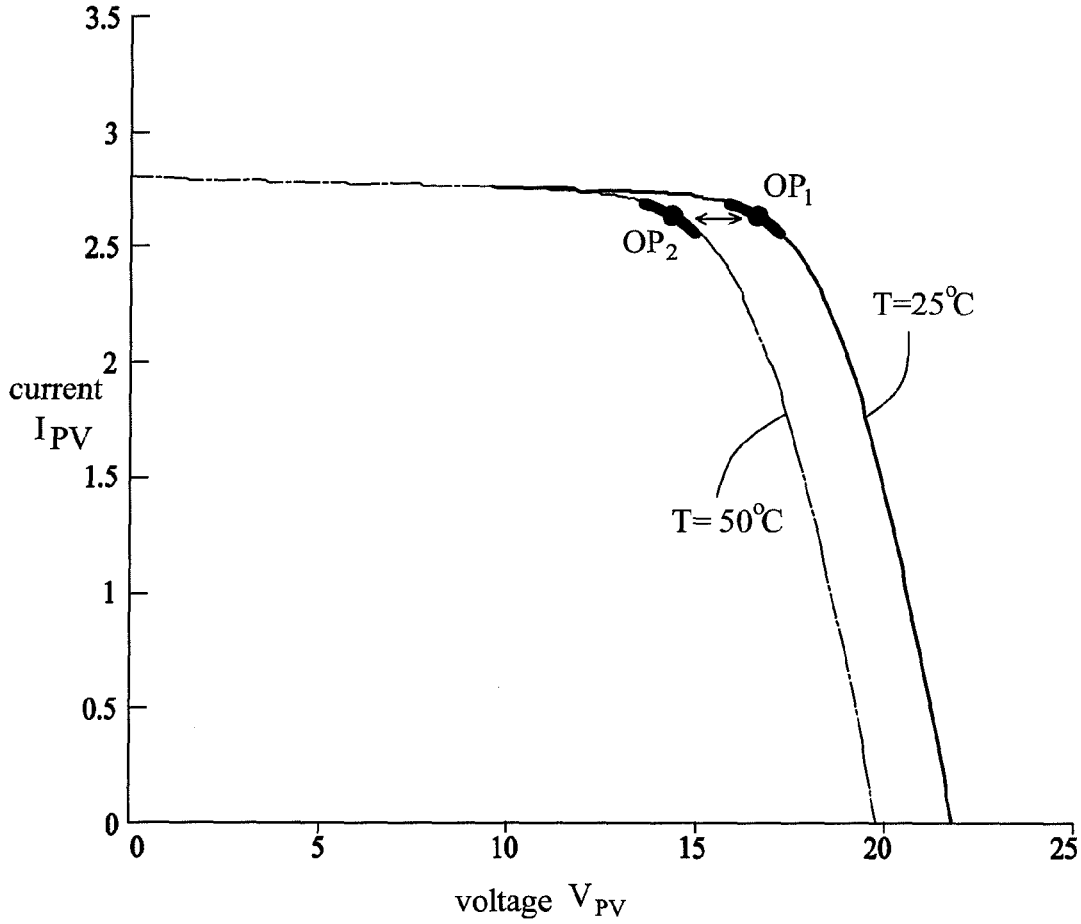
FIG. 5A is an illustration of characteristic curves of an output voltage and an output current of a power output module under different ambient temperatures.
Figure 5B:
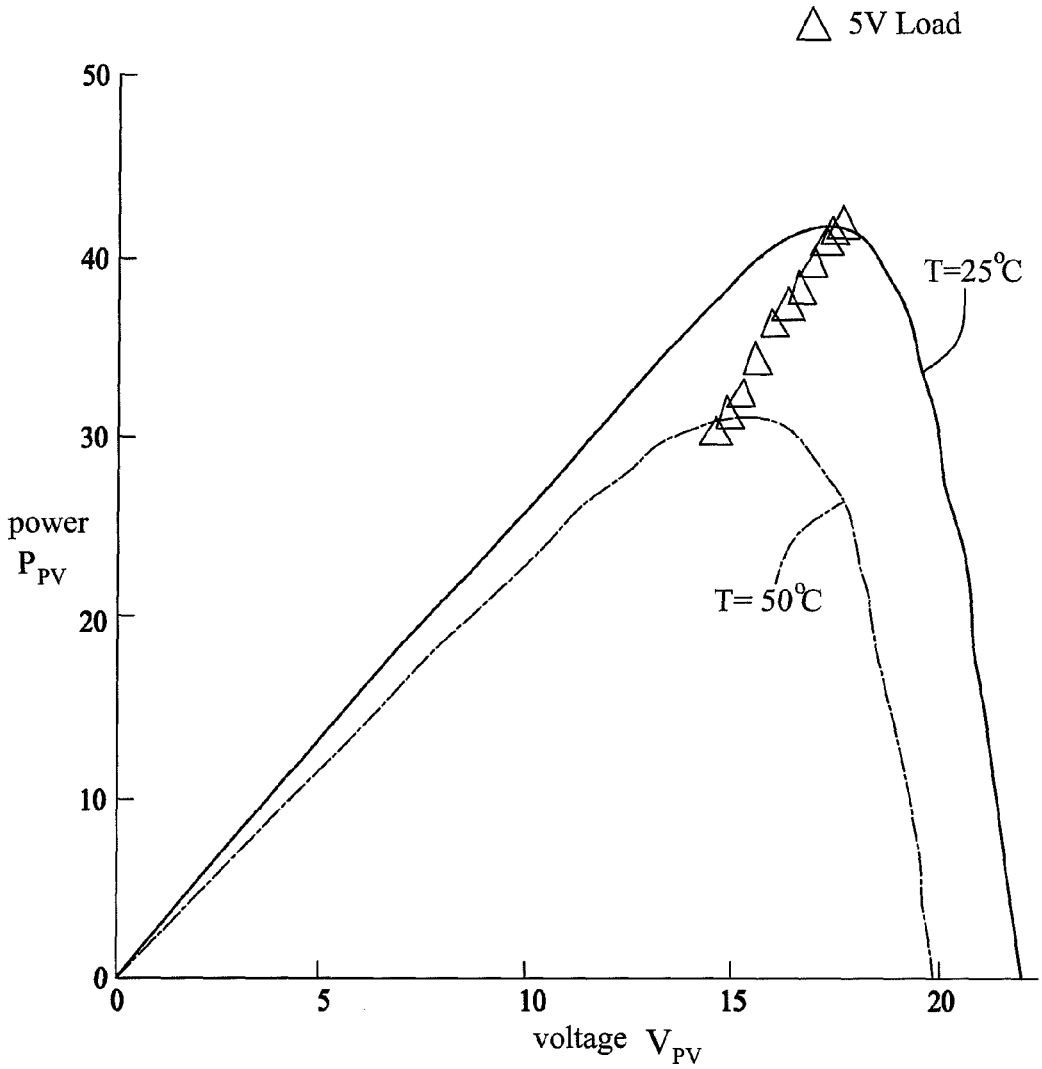
FIG. 5B is an illustration of characteristic curves of an output power and an output voltage of a power output module under different ambient temperatures.

FIG. 5A is an illustration of characteristic curves of an output voltage ($V_{PV}$) and an output current ($I_{PV}$) of the power output module 3 under different ambient temperatures, and FIG. 5B is an illustration of characteristic curves of an output power ($P_{PV}$) and an output voltage ($V_{PV}$) of the power output module 3 under different ambient temperatures. As shown in FIGS. 5A and 5B, the ambient temperatures of the characteristic curves are 50 degrees Celsius and 25 degrees Celsius respectively.

As shown in the figures, the curvatures of the characteristic curves of the output voltage $V_{PV}$ and current $I_{PV}$ of the power output module 3 remain the same under different ambient temperatures, and the characteristic curves only moves left and right. Therefore, without having to change its internal circuits, the control circuit 2 of the present invention can still limit the output power of the power output module 3 within the maximum power under different ambient temperatures.

Based on the above mentioned, according to the duty cycle reference signal DCS and the feedback signal FS, the control unit 24 of the control circuit 2 of the present invention outputs a control signal CS to control an actuation of the switch element 211 of the conversion unit 21 to re-start the conversion unit 21, and cause the power output module 3 to output over again, thereby limiting the output power of the power output module 3 within the maximum power region. Furthermore, the control circuit 2 of the present invention is an analog circuit. Comparing with the conventional control circuits which use digital chips, it is simpler structurally and the circuit cost is lower.

Figure 6:
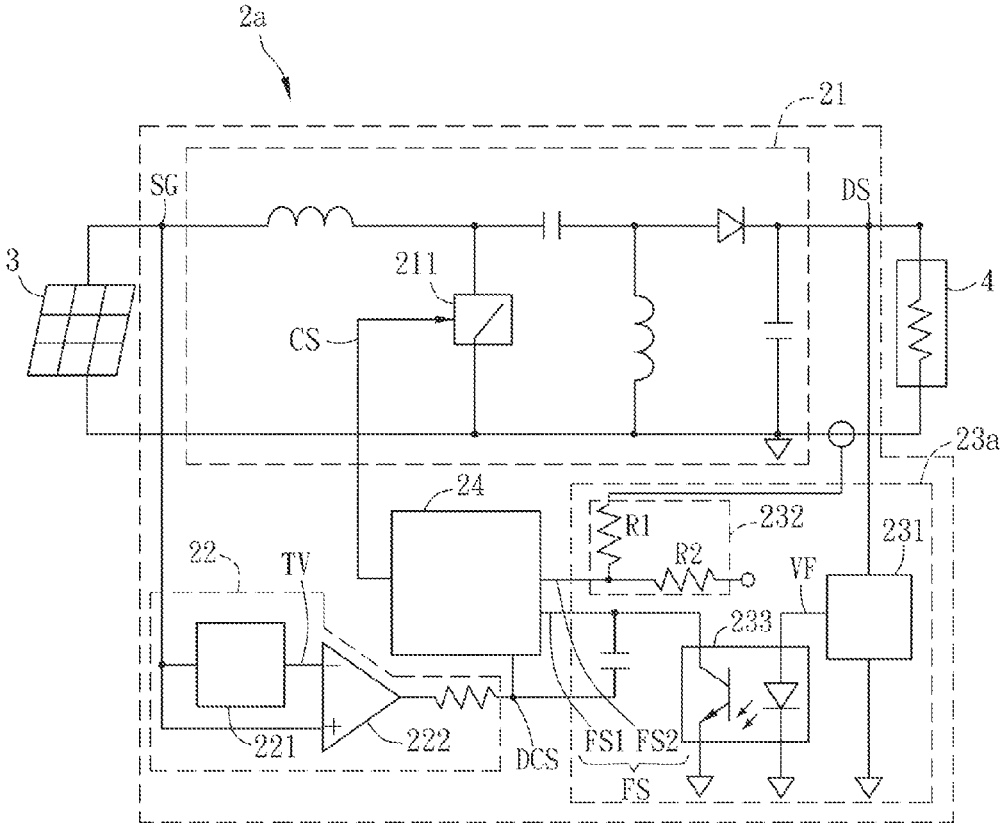
FIG. 6 is another circuit diagram of a control circuit according to the present invention.

FIG. 6 is a circuit diagram of another control circuit 2*a* according to the present invention.

Referring to FIG. 6, main differences between the control circuit 2*a* and the control circuit 2 lie in that, a feedback unit 23*a* of the control circuit 2*a* further includes an isolation element 233, which is electrically connected with the compensator 231 and the control unit 24. The isolation element 233 outputs the voltage feedback signal FS1 according to the voltage feedback compensation signal VF, and inputs it into the control unit 24. The isolation element 233 can be, for examples, an optical coupler or a transformer. An optical coupler is used for the isolation element 233 here as an example. The isolation element 233 isolates the compensator 231 and the control unit 24 from each other to avoid interferences between their signals.

Furthermore, the connections and functions of other components in the control circuit 2*a* are the same as those in the control circuit 2, so the detailed descriptions thereof will be omitted.

Figure 7:
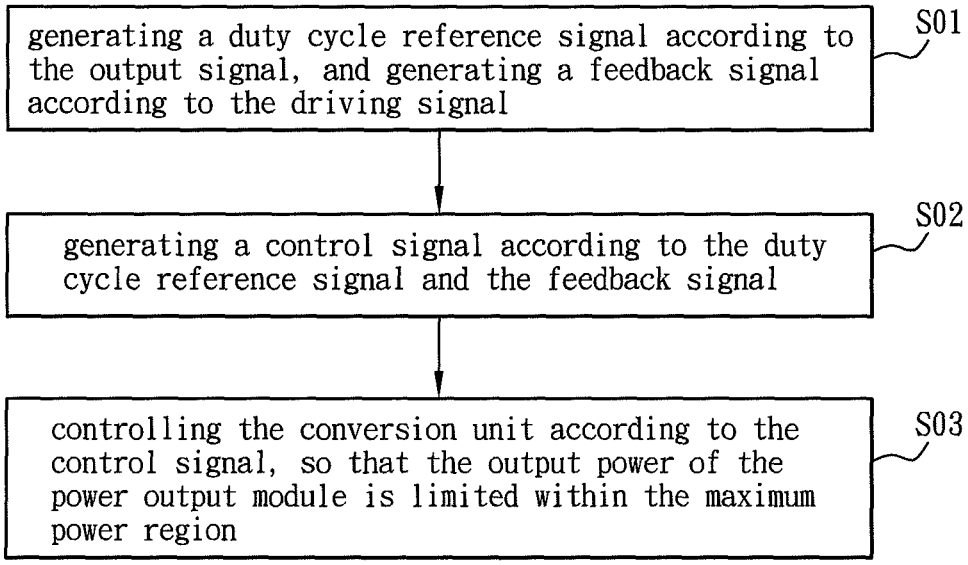
FIG. 7 is a flowchart of a tracking method of maximum power according to the present invention.

FIG. 7 is a flowchart of a tracking method of maximum power according to the present invention. The tracking method of the maximum power of the present invention will be illustrated hereinafter with reference to FIGS. 6 and 7.

The tracking method of the maximum power is applied to a power output module 3, and the power output module 3 outputs an output signal SG A conversion unit 21 outputs a driving signal DS according to the output signal SG to drive a load device 4. The tracking method of the maximum power includes steps S01 to S03.

The step S01 is to generate a duty cycle reference signal DCS according to the output signal SG, and to generate a feedback signal FS according to the driving signal DS. Before the duty cycle reference signal DCS is generated, the method may further include a step of generating a transient voltage average signal TV according to the output signal SG. Before the duty cycle reference signal DCS is generated, the method may further include a step of generating subtracting between the output signal SG and the transient voltage average signal TV. Before the feedback signal FS is generated, the method may further include a step of generating a voltage feedback compensation signal VF according to a voltage of the driving signal DS. In addition, before the feedback signal FS is generated, the method may further include a step of generating a voltage feedback signal FS1 of the feedback signal FS according to the voltage feedback compensation signal VF. Furthermore, before the feedback signal FS is generated, the method may further include a step of converting a current feedback signal FS2 of the feedback signal FS by sensing a current of the power output module.

The step S02 is to generate a control signal CS according to the duty cycle reference signal DCS and the feedback signal FS. The control unit 24 integrates the duty cycle reference signal DCS and the feedback signal FS, and outputs the control signal CS.

The step S03 is to control the conversion unit 21 according to the control signal CS, so that the output power of the power output module 3 is limited within the maximum power region. The control unit 24 can compare the duty cycle reference signal DCS with a preset reference value. When the duty cycle reference signal DCS is larger than the preset reference value, the control unit 24 outputs the control signal CS to control a switch element 211 of the conversion unit 21. In this embodiment, when the duty cycle reference signal DCS is larger than the preset reference value, the control unit 24 can control the switch element 211 to re-start the conversion unit 21, and cause the power output module 3 to output the output signal SG again. Therefore, the control circuit 2*a* of the present invention can limit the output power of the power output module 3 within the maximum power region.

Other actuations of the control circuit 2*a* have been described in details in the abovementioned embodiment, so the details thereof will be omitted.

To sum up, in the control circuit and tracking method of the maximum power of the present invention, the feed-forward unit generates a duty cycle reference signal according to the output signal of the power output module, and the feedback unit generates a feedback signal according to the driving signal output by the conversion unit. Besides, the control unit outputs a control signal to control the actuation of the switch element of the conversion unit to re-start the conversion unit, and cause the power output module to output over again according to the duty cycle reference signal and the feedback signal. Thus, the control circuit of the present invention can limit the output power of the power output module within the maximum power region, and the control circuit has a tracking function of the maximum power. In addition, the control circuit of the present invention is an analog circuit, comparing with the conventional control circuits which use digital chips, it is simpler structurally and the circuit cost is lower.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A control circuit to control a power output module, and to drive a load device, the control circuit comprising:

a conversion unit electrically connected with the power output module and the load device, and generating a driving signal according to an output signal of the power output module to drive the load device;

a feed-forward unit electrically connected with the power output module and the conversion unit, and generating a duty cycle reference signal according to the output signal;

a feedback unit electrically connected with the conversion unit, the load device and the feed-forward unit, and generating a feedback signal according to the driving signal, wherein the feedback signal comprises a voltage feedback signal and a current feedback signal; and a control unit electrically connected with the feed-forward unit, the feedback unit and the conversion unit, and outputting a control signal to control the conversion unit according to the duty cycle reference signal and the feedback signal, thereby limiting an output power of the power output module within a maximum power region, wherein the control unit controls a duty cycle of the output signal of the power output module according to the voltage feedback signal, wherein the duty cycle reference signal is provided to the feedback unit and the control unit.

2. The control circuit according to claim 1, wherein the conversion unit has a switch element, and the control signal controls to turn on the switch element, thereby causing the power output module to output the output signal over again.

3. The control circuit according to claim 1, wherein the conversion unit is a DC/DC converter or a DC/AC converter.

4. The control circuit according to claim 1, wherein the feedback unit comprises a compensator electrically connected with the conversion unit, and converting a voltage of the driving signal into a voltage feedback compensation signal.

5. The control circuit according to claim 4, wherein the feedback unit further comprises an isolation element electrically connected with the compensator and the control unit, and outputting the voltage feedback signal to the control unit according to the voltage feedback compensation signal.

6. The control circuit according to claim 1, wherein the feedback unit further comprises a voltage dividing element electrically connected with the control unit, and converting a current of the driving signal into the current feedback signal, and inputting it into the control unit.

7. The control circuit according to claim 1, wherein the control unit integrates the duty cycle reference signal and the feedback signal, and outputs the control signal to control an actuation of the conversion unit.

8. The control circuit according to claim 1, wherein when the duty cycle reference signal is larger than a preset reference value, the control unit outputs the control signal.

9. A tracking method of a maximum power being applied to a power output module, the power output module outputting an output signal, a conversion unit outputting a driving signal according to the output signal to drive a load device, the tracking method comprising steps of:

generating a duty cycle reference signal by a feed-forward unit according to the output signal;

generating a feedback signal by a feedback unit according to the driving signal, wherein the feedback signal comprises a voltage feedback signal and a current feedback signal;

providing the duty cycle reference signal to the feedback unit and a control unit;

generating a control signal by the control unit according to the duty cycle reference signal and the feedback signal; and controlling the conversion unit according to the control signal, so that an output power of the power output module is limited within a maximum power region, wherein a duty cycle of the output signal of the power output module is controlled according to the voltage feedback signal.

10. The method according to claim 9, wherein the control signal controls to turn on a switch element of the conversion unit.

11. The method according to claim 9, wherein before the step of generating the feedback signal, the method further comprises a step of:

generating a voltage feedback compensation signal according to a voltage of the driving signal.

12. The method according to claim 11, wherein before the step of generating the feedback signal, the method further comprises a step of:

generating the voltage feedback signal according to the voltage feedback compensation signal.

13. The method according to claim 9, wherein before the step of generating the feedback signal, the method further comprises a step of:

sensing a current of the driving signal and converting it into the current feedback signal.

14. The method according to claim 9, further comprising a step of:

integrating the duty cycle reference signal and the feedback signal, and outputting the control signal.

15. The method according to claim 9, further comprising a step of comparing the duty cycle reference signal with a preset reference value.

16. The method according to claim 15, wherein when the duty cycle reference signal is larger than the preset reference value, the control unit outputs the control signal to control an actuation of the conversion unit.

17. The control circuit according to claim 1, wherein the feed-forward unit comprises a low pass filter electrically connected with the power output module, and generating a transient voltage average signal according to the output signal.

18. The control circuit according to claim 17, wherein the feed-forward unit further comprises a subtractor electrically connected with the power output module and the low pass filter, and subtracting the output signal and the transient voltage average signal with each other, so that the duty cycle reference signal is generated and inputted into the control unit.

19. The method according to claim 9, wherein before the step of generating the duty cycle reference signal, the method further comprises a step of:

generating a transient voltage average signal according to the output signal.

20. The method according to claim 19, wherein before the step of generating the duty cycle reference signal, the method further comprises a step of:

subtracting the output signal and the transient voltage average signal with each other.

* * * * *